US008147956B2

(12) United States Patent
Miyauchi et al.

(10) Patent No.: US 8,147,956 B2
(45) Date of Patent: Apr. 3, 2012

(54) HOT-MELT ADHESIVE POLYESTER CONJUGATE FIBER

(75) Inventors: Minoru Miyauchi, Osaka (JP); Tadashi Ideguchi, Osaka (JP); Masashi Teranaka, Osaka (JP)

(73) Assignees: ES Fiber Visions Co., Ltd., Osaka (JP); ES Fiber Visions Hong Kong Limited, Kowloon (HK); ES Fiber Visions LP, Athens, GA (US); ES Fiber Visons APS, Verde (DK)

( * ) Notice: Subject to any disclaimer, the term of this patent is extended or adjusted under 35 U.S.C. 154(b) by 0 days.

(21) Appl. No.: 12/738,710

(22) PCT Filed: Oct. 20, 2008

(86) PCT No.: PCT/JP2008/069394

§ 371 (c)(1),
(2), (4) Date: Apr. 19, 2010

(87) PCT Pub. No.: WO2009/051283

PCT Pub. Date: Apr. 23, 2009

(65) Prior Publication Data

US 2010/0273947 A1 Oct. 28, 2010

(30) Foreign Application Priority Data

Oct. 19, 2007 (JP) ..... 2007-272636
Oct. 15, 2008 (JP) ..... 2008-266284

(51) Int. Cl.
*D02G 3/00* (2006.01)

(52) U.S. Cl. ..... 428/373; 428/374; 428/395; 525/165; 525/445

(58) Field of Classification Search ..... 525/165, 525/445; 428/373, 374, 395
See application file for complete search history.

(56) References Cited

U.S. PATENT DOCUMENTS

| | | | | |
|---|---|---|---|---|
| 6,531,214 | B2 | 3/2003 | Carter et al. | |
| 2006/0172637 | A1 | 8/2006 | Hosokawa et al. | |
| 2009/0029165 | A1 * | 1/2009 | Goda | 428/374 |

FOREIGN PATENT DOCUMENTS

| | | | |
|---|---|---|---|
| EP | 0605727 | | 11/1998 |
| JP | 05-287609 | | 11/1993 |
| JP | 8-246246 | | 9/1996 |
| JP | 8-260239 | | 10/1996 |
| JP | 09-170116 | * | 6/1997 |
| JP | 11-21737 | | 1/1999 |
| JP | 2000-336526 | | 12/2000 |
| JP | 2002-115117 | | 4/2002 |
| JP | 2003-3334 | | 1/2003 |
| JP | 2007-9339 | | 1/2007 |
| JP | 2007-204902 | | 8/2007 |
| JP | 2007-303035 | | 11/2007 |
| TW | 221465 | | 3/1994 |
| TW | 552289 | | 9/2002 |
| TW | I286171 | | 9/2007 |
| WO | WO 2007/091662 | * | 8/2007 |
| WO | 2007/132905 | | 11/2007 |

* cited by examiner

*Primary Examiner* — David W Wu
*Assistant Examiner* — Robert Jones, Jr.
(74) *Attorney, Agent, or Firm* — Hamre, Schumann, Mueller & Larson, P.C.

(57) ABSTRACT

To obtain an ultrafine heat-shrinkable conjugate fiber at high productivity, in which a flow-drawing state of a polyester undrawn yarn is realized easily and stably.

By drawing undrawn yarn comprising a conjugated polyester polymer and olefin polymer, a flow-drawing process can be easily and stably realized using conventional production facilities; and the heat-shrinkable fiber, a drawn intermediate, and an ultrafine hot-melt adhesive conjugate fiber produced by redrawing the drawn intermediate of the present invention can be obtained with high productivity and excellent runnability. More specifically, the ultrafine hot-melt adhesive conjugate fiber obtained by redrawing can be drawn at a heretofore unseen high drawing magnification, and the fiber structure of the olefin polymer constituting part of the conjugate fiber is markedly developed. The heat-shrinkable fiber and ultrafine hot-melt adhesive conjugate fiber thus obtained can be suitably used in hygiene products and industrial materials by utilizing these features.

13 Claims, No Drawings

HOT-MELT ADHESIVE POLYESTER CONJUGATE FIBER

BACKGROUND OF THE INVENTION

1. Technical Field

The present invention relates to a conjugate fiber comprising a polyester polymer and an olefin polymer, and more particularly, the present invention relates to a conjugate fiber having both the proper amount of heat shrinkage and hot-melt adhesive properties, and a drawn intermediate in which a fine conjugate fiber can be obtained therefrom with high productivity, and an ultrafine conjugate fiber having high strength and excellent thermal stability.

2. Background Art

Olefin fibers such as polyethylene and polypropylene are widely used for hygiene products, filters, etc., because they are safe with respect to the skin, have a small environmental burden, excellent chemical resistance, and the like. On the other hand, polyester fibers such as polyethylene terephthalate and the like are widely used for clothing, industrial materials, etc., because they have high heat resistance, pleat retention properties, and the like. Moreover, the need has arisen to make single yarn increasingly finer to enhance the softness of the texture, softness of the fabric, draping properties, and the like even more.

Generally, method such as spinning ultrafine, undrawn yarn, drawing at a high magnification, and the like have been adopted to reduce the fineness. However, attempting to spin ultrafine, undrawn yarn can bring about a decline in productivity associated with a decrease in the discharge amount, or a decrease in both runnability and productivity associated with an increase in the number of fiber breakage events caused by a high spinning speed, adopted for producing said fiber. Attempting to draw at a high magnification can result in fiber breakage if the magnification is too high, and the fineness of the drawn yarn obtained thereby is self-limiting.

Concerning ultrafine yarn, it has been proposed that drawing an undrawn polyester yarn at a high drawing magnification is possible by drawing at a temperature higher than the glass transition temperature thereof, and that an ultrafine polyester fiber can be obtained thereby (see Patent Reference 1). This involves creating a flow-drawing state by performing a first stage drawing treatment at a high temperature and forming fine fibers while restricting fiber structure development, and then forming even finer fibers while developing the fiber structure in a second stage drawing treatment. There are problems with this method, however, because when attempting to restrict fiber structure development enough for it to be drawn in the second stage, it is necessary to increase the drawing temperature in the first stage and perform drawing at low tension. This can invite instability in the process because the fiber yarn can droop under its own weight as a result of the low tension, and fiber breakage due to drawing can occur because the tension fluctuates greatly in response to fluctuations in drawing temperature. Thus, stable operation and uniform fiber properties cannot be obtained thereby. Furthermore, it has been found that when such a method is applied to polyolefin fibers, the undrawn yarn comprising the olefin material has been crystallized, or tends to crystallize during the drawing process, and because the molecular chains are bent to the extreme, a flow-drawing state cannot be reached therewith. Thus, this has hampered efforts to apply the above drawing method industrially to fibers containing olefin polymer resin material, and exploring that avenue has received no attention.

Another proposal involves creating a uniform flow-thawing state with high-speed in substantial polyester fibers and nylon fibers by heating rapidly with irradiation of infrared rays (see Patent Reference 2). There is a problem with that method, however, because the irradiated area is restricted when heating is performed with a beam of infrared light, and that results in low productivity since many fiber yarn lines cannot be heated all at a time.

[Patent Reference 1] Japanese Patent Application Laid-open No. H11-21737

[Patent Reference 2] Japanese Patent Application Laid-open No. 2002-115117

DISCLOSURE OF THE INVENTION

Thus, investigations are being conducted on polyester-based fibers that involve an attempt to obtain ultrafine fibers with high productivity by performing flow-drawing, but stable runnability has not been achieved, sufficient productivity has not been achieved, and satisfactory results have still not been obtained.

An object of the present invention is to realize a simple and stable flow-drawing process for polyester-based undrawn yarn, and thereby obtain a heat-shrinkable conjugate fiber with high productivity, obtain a drawn intermediate capable of being redrawn in the next process step, and obtain an ultrafine hot-melt adhesive conjugate fiber by redrawing that drawn intermediate.

As the result of diligent research to solve the above problems, the inventors found that by creating an undrawn yarn wherein an olefin polymer is conjugated with a polyester-based polymer, the flow-drawing process unexpectedly stabilizes, and thus a heat-shrinkable conjugate fiber, a drawn intermediate thereof, and an ultrafine hot-melt adhesive conjugate fiber produced by redrawing that drawn intermediate can be obtained with high productivity and excellent runnability. In particular, in completing the present invention the inventors found that the olefin polymer constituting part of the conjugate fiber takes the form of a constituent component of the conjugate fiber together with the polyester-based polymer, and unexpectedly high levels of drawablity and orientation that are impossible to attain in fibers using an olefin polymer alone are realized. Moreover, fiber structure development occurs in accordance therewith, and this fiber structure development is realized as enhanced performance of the conjugate fiber itself resulting from a synergistic effect that is greater than the simple effect of combining the polyester-based polymer and olefin polymer.

The present invention comprises the features listed below.

(1) A hot-melt adhesive conjugate fiber obtained by drawing an undrawn yarn having a polyester as a first component and an olefin polymer with a melting point lower than the first component, as a second component, the hot-melt adhesive conjugate fiber being characterized in that the birefringence of the polyester first component of the conjugate fiber is not more than 0.150, and the birefringence ratio of the first component to the second component (birefringence of the first component/birefringence of the second component) is not more than 3.0.

(2) The hot-melt adhesive conjugate fiber of (1) above, which is a type of conjugation in which the second component completely covers the fiber surface.

(3) The hot-melt adhesive conjugate fiber of (1) or (2) above, characterized in that the standard deviation of fiber diameter is not more than 4.0.

(4) The hot-melt adhesive conjugate fiber of any one of (1) to (3) above, characterized in that the single yarn fiber strength is not more than 2.0 cN/dtex, and the elongation is not less than 100%.

(5) The hot-melt adhesive conjugate fiber of any one of (1) to (4) above, characterized in that the mean index of refraction of the polyester first component is not more than 1.600.

(6) The hot-melt adhesive conjugate fiber of any one of (1) to (5) above, characterized in that the olefin polymer second component is a high density polyethylene.

(7) The hot-melt adhesive conjugate fiber of any one of (1) to (6) above, characterized in that the dry heat shrinkage resulting from a heat treatment of 145° C. for 5 minutes is not less than 15%.

(8) A hot-melt adhesive conjugate fiber comprising a polyester as a first component and an olefin polymer with a melting point lower than the first component as a second component, the hot-melt adhesive conjugate fiber being characterized in that the degree of orientation of the c-axis of the crystalline member of the second component of the hot-melt adhesive conjugate fiber is not less than 90%, and the single yarn fiber strength thereof is not less than 1.7 cN/dtex.

As a specific example of the polyester, one having polyethylene terephthalate as the main component thereof can be noted.

As an example of the method for obtaining the hot-melt adhesive conjugate fiber, a method that includes redrawing of any one of the conjugate fibers in (1) to (7) above can be noted.

(9) The hot-melt adhesive conjugate fiber of (8) above, obtained by redrawing the conjugate fiber of any one of (1) to (7) above.

(10) The hot-melt adhesive conjugate fiber of (8) or (9) above, characterized in that the fineness is not more than 4.0 dtex.

(11) The hot-melt adhesive conjugate fiber of any one of (8) to (10) above, characterized in that the standard deviation of the fiber diameter is not more than 4.0.

(12) In addition, the present invention is intended for a sheet-shaped fiber assembly obtained by processing the hot-melt adhesive conjugate fiber of any one of (1) to (11) above.

In the past, when industrial attempts were made to flow-draw undrawn yarn comprising polyester polymers alone, there were problems in the stability of the process steps and quality stability of the fiber obtained thereby, and even when attempts were made to draw an undrawn yarn comprising an olefin polymer by flow-drawing at a high magnification, the flow-drawing process could not be realized.

In accordance with the present invention is it possible to realize the flow-thawing process easily and stably using existing production equipment by creating an undrawn yarn wherein an olefin polymer is conjugated with a polyester-based polymer, and thus a heat-shrinkable conjugate fiber, a drawn intermediate thereof, and an ultrafine hot-melt adhesive conjugate fiber produced by redrawing the drawn intermediate can be obtained with high productivity and excellent runnability.

In particular, the ultrafine hot-melt adhesive conjugate fiber obtained by redrawing can be drawn at a previously unseen high magnification, and the fiber structure of the olefin polymer that constitutes part of the conjugate fiber is markedly developed. By making good use of these properties, the heat-shrinkable fiber and ultrafine hot-melt adhesive conjugate fiber obtained thereby can be suitably applied in hygiene products such as diapers, napkins, and the like, and in industrial materials such as filter material and the like.

BEST MODE FOR CARRYING OUT THE INVENTION

The best mode for carrying out the invention is described in detail below.

The first hot-melt adhesive conjugate fiber of the present invention is a conjugate fiber obtained by drawing undrawn yarn comprising a polyester as the first component and an olefin polymer having a melting point lower than the first component as the second component, characterized in that the birefringence of the polyester first component thereof is ≦0.150, and the birefringence ratio of the first component to the second component (birefringence of the first component/birefringence of the second component) thereof is ≦3.0.

The polyester first component is not particularly limited in the present invention and examples include a polyalkylene terephthalate such as polyethylene terephthalate and polytrimethylene terephthalate, polybutylene terephthalate and the like; a biodegradable polyester such as polylactate and the like; and a copolymer of the above and another ester forming component, etc. Examples of another ester forming component include a glycol such as diethylene glycol, polymethylene glycol and the like; and an aromatic dicarboxylic acid such as isophthalic acid, hexahydroterephthalatic acid, and the like. When a copolymer comprising another ester forming component is used, the composition thereof is not particularly limited in the present invention, but it is preferable that crystallinity not be greatly lost, and from this viewpoint, it is desirable that the copolymer component preferably be ≦10 wt %, and more preferably ≦5 wt %. These ester polymers may be used alone or in combinations of 2 or more types without a problem. In consideration of the raw material costs, heat stability of the obtained fiber, and the like, a polyester having polyethylene terephthalate as the main component thereof is preferred, and more preferably, an unmodified polymer consisting of polyethylene terephthalate alone is most suitable.

The olefin polymer second component is not particularly limited in the prevent invention provided it has a lower melting point than the first component. Examples include low density polyethylene, linear low density polyethylene, high density polyethylene, and the maleic anhydride-modified products of those ethylene polymers; and ethylene-propylene copolymer ethylene-butene-propylene copolymer, polypropylene, and the maleic anhydride-modified products of those propylene polymers; poly-4-methylpentene-1; and the like.

These olefin polymers may be used alone or in combinations of 2 or more types without a problem. Among these, an olefin polymer containing ≧90 wt % high density polyethylene is preferred from the viewpoint of controlling the phenomenon wherein olefin polymers exposed on the fiber surface fuse without completely solidifying in the cooling process during spinning.

In addition, the melt flow rate (test temperature 230° C., test load of 21.18 N) of the olefin polymer is not particularly limited in the present invention, but preferably it is ≧8 g/10 min, more preferably ≧20 g/10 min, and more preferably ≧40 g/10 min. When different components are conjugated and spun, both components affect each other and the structure of the undrawn yarn changes, but when a polyester and an olefin polymer are conjugated, the larger the olefin polymer melt flow rate, the smaller the birefringence of the polyester tends to be. If the melt flow rate of the olefin polymer is ≧20 g/10 min, it is possible to easily obtain undrawn yarn, in which the first component birefringence is low, and if the melt flow rate is ≧40 g/10 min, it is possible to obtain undrawn yarn, in which the birefringence is even lower. If an undrawn yarn with a low first component birefringence can be obtained, that is preferred because the flow-drawing state can easily be realized in the flow-drawing process.

The flow-drawing process and flow-drawing state refer to a drawing behavior realizing a low strain rate due to drawing at a temperature high enough that the polymer chains can flow sufficiently and opening of the entangled polymer chain structure occurs. By performing drawing while opening up the entangled polymer chain structure, tension of the polymer chains at the points of entanglement is suppressed, and it is possible to perform drawing without much polymer chain orientation. This is opposite of the widely-known neck drawing process that is accompanied by oriented crystallization and fiber structure development.

It is important to make a conjugated structure comprising the polyester first component and the olefin polymer second component to obtain the effect of the present invention wherein the flow-drawing process of the polyester undrawn yarn is realized easily and stably.

As described in Patent Reference 1 and Patent Reference 2 above, the polyester undrawn yarn reaches a flow-drawing state if drawing is performed at a temperature somewhat higher than the glass transition temperature thereof and under conditions wherein the strain rate is low. Drawing can be performed thereby at a high magnification while restricting fiber structure development. There have been major problems with this method, however, because when undrawn yarn comprising ester polymers alone is flow-drawn, the drawing tension acting on the fiber yarn lines is very low, since the polymer fluidity reaches a high level at a drawing temperature equal to or greater than the glass transition temperature, and problems occur such as the drawing lines drooping under their own weight, fiber breakage due to contact with the drawing equipment, thereby drawing unevenness, and the like. Other problems also occur such as large changes in the drawing tension resulting from slight fluctuations in the drawing temperature, fiber breakage, unevenness in fineness, and the like. As a result, satisfactory runnability, productivity, and stable quality cannot be obtained.

However, a conjugate undrawn yarn having conjugated therein an ester polymer that can achieve a flow-drawing state as the first component and an olefin polymer, which has previously been excluded from industrial applications involving that method because it cannot achieve a flow-drawing state, as the second component does not have problems such as fiber breakage due to contact with the drawing equipment, drawing unevenness, and the like. That is because the first component is drawn at high magnification to produce fine fibers while restricting development of the fiber structure by drawing under drawing conditions wherein the first component achieves a flow-drawing state but the olefin polymer does not melt. Moreover, because the olefin polymer second component does not participate in the flow-drawing process, a large drawing tension acts thereon, and as a result, a sufficiently suitable drawing tension can be applied so that the drawn conjugate fiber as a whole does not droop under its own weight. In addition, high productivity and stable quality can be obtained thereby since it becomes possible to dramatically reduce fiber breakage due to drawing and unevenness in fineness, possibly because the olefin polymer absorbs the changes in tension resulting from fluctuations in drawing temperature.

The fineness of the hot-melt adhesive conjugate fiber obtained after the undrawn yarn comprising the polyester first component and olefin polymer second component having a melting point lower than that of the first component undergoes the flow-drawing process is not particularly limited in the present invention, but preferably the fineness thereof will be 1.0 to 20 dtex and more preferably 2.0 to 10 dtex.

Because the fiber structure is not very developed in the hot-melt adhesive conjugate fiber that has undergone the flow-drawing process, the single yarn fiber strength is low (hereinafter, the term "fiber strength" refers to single yarn fiber strength). Although it is possible that fiber breakage and entanglement may occur when sending the product to subsequent process steps such as drying, cutting, etc., the tenacity per single fiber will be sufficient if the fineness is ≧1.0 dtex, and fiber breakage and entanglement will not occur. If the fineness value of the hot-melt adhesive conjugate fiber that has undergone the flow-drawing process is too large, the temperature distribution across the fiber cross section tends to be higher during the flow-drawing process, structural unevenness and stress concentrations occur inside the fibers, and the fiber strength may be markedly decreased. However, if the fineness is ≦20 dtex, the problems of structural unevenness and stress concentrations inside the fibers disappear, and a satisfactory fiber strength can be obtained. A fiber strength in the range of 2.0 to 10 dtex is optimal because the single fiber tenacity will reach a suitable level, and trouble will not occur in subsequent process steps.

The standard deviation of the hot-melt adhesive conjugate fiber that has undergone the aforementioned flow-drawing process is not particularly limited in the present invention, but preferably the standard deviation of the fiber diameter will be ≦4.0, and more preferably ≦3.0. As noted above, when flow-drawing is attempted on undrawn yarn comprising ester polymers alone, there are problems because the process becomes unstable and unevenness in fineness increases. These problems have invited a decrease in productivity and in quality, but the hot-melt adhesive conjugate fiber of the present invention has a component comprising an olefin polymer conjugated therein, and the result is a surprising stabilization of the drawing process and restriction of unevenness of fineness. A standard deviation of the fiber diameter of ≦4.0 is preferred because the flow-drawing process is stably realized and quality becomes uniform, and a standard deviation of ≦3.0 is more preferred because even higher levels of stability and quality uniformity are obtained thereby.

In the first hot-melt adhesive conjugate fiber of the present invention additives to exhibit various types of performance such as antioxidants and photostabilizers, UV light absorbers, neutralizers, nucleating agents, antibacterial agents, deodorizing agents, flame retardants, antistatic agents, pigments, plasticizers, and the like may be suitably added as needed to the polyester first component and the olefin polymer second component within a range that does not interfere with the effect of the present invention.

The type of conjugation of the first component and the second component is not particularly limited in the first hot-melt adhesive conjugate fiber of the present invention, but a type of conjugation wherein the second component completely covers the fiber surface is preferred, and among such types, a concentric or eccentric sheath-core structure is preferred.

The flow-drawing process can be easily and stably realized provided an undrawn yarn having a polyester first component and olefin polymer second component conjugated therein is used, but when the type of conjugation is one wherein the second component completely covers the fiber surface, the problem of agglutination of the polyester component that occurs when drawing is performed at or above the glass transition temperature of the polyester component can be solved, and therefore such a type is more preferred.

In addition, any type of cross-sectional shape of the fiber can be used, e.g., a round shape such as circular or elliptical; an angular shape such as triangular or quadrangular; an atypical shape such as key-shaped or octolobal; a hollow shape and the like.

The structural ratio when conjugating the first component and second component is not particularly limited in the present invention, but a ratio of second component/first component=70/30 to 10/90 vol % is preferred, and 60/40 to 30/70 vol % is more preferred. A structural ratio of ≧10 vol % for the second component is preferred for realizing a suitable drawing tension during the flow-thawing process due to the presence of the olefin polymer second component, and the flow-drawing process can be stabilized without the problem of the drawn fibers drooping under their own weight. In addition, the structural ratio of the second component will affect the fineness behavior when spinning undrawn yarn by melt spinning, and if the ratio of the second component is high the fineness curve tends to shift in a direction wherein the birefringence of the polyester first component is greater.

Therefore, it is preferable that the structural ratio of the second component be low, and a ratio ≦70 vol % is preferred because the birefringence of the polyester first component in the undrawn yarn will be sufficiently low, and the flow-drawing state can be easily realized in the flow-drawing process. A case wherein the structural ratio of second component/first component=60/40 to 40/60 vol % is even more preferred because of the excellent balance between stability in the flow-drawing process and ease of realizing the same.

The undrawn yarn comprising a polyester as the first component and an olefin polymer having a melting point lower than the first component as the second component that forms the raw material of the first hot-melt adhesive conjugate fiber of the present invention can be obtained by a general melt spinning method. The temperature conditions at the time of melt spinning are not particularly limited in the present invention, but preferably the spinning temperature will be ≧250° C., more preferably ≧280° C., and even more preferably ≧300° C. A spinning temperature of ≧250° C. is preferred because the number of yarn breakage events during spinning will be decreased, and an undrawn yarn that can easily realize the flow-drawing state during the flow-drawing process can be obtained. These effects are more pronounced at a spinning temperature of ≧280° C., and even more pronounced at ≧300° C.

The spinning rate is not particularly limited in the present invention, but preferably is 300 to 1500 m/min, and more preferably 600 to 1000 m/min. A spinning rate of ≧300 m/min is preferred because it is possible to increase the single hole discharge amount and obtain satisfactory productivity when attempting to obtain an undrawn yarn with the desired spinning fineness. A spinning rate of ≦1500 m/min is preferred because the birefringence of the first component in the undrawn yarn is sufficiently decreased, and the flow-drawing state can easily be realized during the flow-drawing process. If the spinning rate is in the range of 600 to 1000 m/min, the balance between productivity and ease of realizing the flow-drawing state is excellent, so a range in this rate is even more preferred.

A prior art method can be used as the cooling method in the process of taking up the fibrous resin discharged from the spinnerets, but to obtain undrawn yarn wherein the molecular orientation of the polyester first component is restricted, i.e., the birefringence of the first component is held low, it is preferable to use conditions that are as gentle as possible.

In the undrawn yarn obtained thereby, the birefringence of the first component is preferably ≦0.020, and more preferably ≦0.015. A first component birefringence of ≦0.020 is preferred because the first component has molecular orientation on such a low level that oriented crystallization during spinning will not occur, and crystalline components that impede realization of the flow-drawing state during the flow-drawing process will not be present. A first component birefringence of ≦0.015 is even more preferred because undrawn yarn wherein the molecular orientation is even more restricted can be obtained and realization of the flow-drawing state during the flow-drawing process is facilitated thereby.

By drawing undrawn yarn obtained thereby under the drawing conditions specified herein, the flow-drawing state can be realized, and a hot-melt adhesive conjugate fiber characterized in that the birefringence of the polyester first component is ≦0.150, and the birefringence ratio of the first component to the second component (birefringence of the first component/birefringence of the second component) is ≦3.0 can be obtained.

As described above, the flow-drawing process refers to drawing while opening up the entangled structure of the molecular chains to increase molecular mobility of the polymer chains constituting the undrawn yarn, and it is a type of drawing that is not accompanied by marked development of the fiber structure because the tension of the molecular chains at the points of entanglement is suppressed. In other words, the drawing temperature is important for increasing polymer chain mobility, and the strain rate (i.e., drawing magnification and drawing speed) at the time of drawing is important for drawing while simultaneously opening up the entangled structure of the polymer chains. Therefore, it is necessary to properly select and establish these conditions.

A preferred drawing temperature is one 30 to 70° C. higher than the glass transition temperature of the polyester first component and lower than the melting point of the polyolefin polymer second component. More preferably, the drawing temperature will be 40 to 60° C. higher than the glass transition temperature of the polyester first component and lower than the melting point of the polyolefin polymer second component.

Herein, the drawing temperature refers to the temperature of the fibers at the starting position for drawing. A drawing temperature of "the glass transition temperature of the polyester first component+30° C." or higher enables the flow-drawing state to be realized, but a higher temperature is preferred because the effect thereof can be obtained even when drawing at a high strain rate, i.e., a high drawing magnification. However, if the drawing temperature is too high, cold crystallization will occur in the first component before the undrawn yarn is drawn, and this will interfere with realization of flow-drawing state. From this viewpoint, a drawing temperature of "the glass transition temperature of the polyester first component+70° C." or lower is preferred. In addition, it is necessary to set the drawing temperature lower than the melting point of the olefin polymer second component, and to control instability during the flow-drawing process due to melting and agglutination between fibers. For example, the preferred drawing temperature will range from 100° C. to 130° C. when drawing an undrawn yarn comprising a polyethylene terephthalate first component with a glass transition temperature of 70° C. and a high density polyethylene second component with a melting point of 130° C.

A low strain rate is preferred when drawing, but this is affected by the drawing speed and drawing magnification. Flow-drawing may be performed in a single step, or in a plurality of two or more steps. Furthermore, no problem whatsoever occurs if traditional neck drawing is performed after performing flow-drawing of one or more steps. Herein, neck drawing refers to a drawing method accompanied by oriented crystallization and fiber structure development due to the drawing. The drawing speed of the flow-drawing process depends on the drawing magnification, but preferably is 5 to 100 m/min and more preferably 10 to 80 m/min. Herein, the drawing speed of the flow drawing process refers to the speed that is reached in the flow-drawing process, and when performing flow-drawing using a speed differential involving two or more pairs of rolls, for example, the drawing speed refers to the speed of the last roll in the flow-drawing process. If the drawing speed is ≦100 m/min, the strain rate is sufficiently small and the flow-drawing state can be easily realized. A drawing speed of ≧5 m/min is preferred because the flow-drawing state can be realized with satisfactory productivity. A drawing speed of 10 to 80 m/min is even more preferred because of the excellent balance between ease in realizing the flow-drawing state and productivity.

The drawing magnification in the flow-drawing process depends on the drawing speed, but 1.2 to 8.0 times is preferred, 1.4 to 5.0 times is more preferred, and 1.6 to 3.0 times is even more preferred. Herein, the drawing magnification of the flow-drawing process refers to the total drawing magnification in the flow-drawing process, and if flow-drawing is performed first at 1.4 times, then again at 1.5 times, and then neck drawing is performed at 3 times, the drawing magnification of the flow-drawing process is 2.1 times. A drawing magnification of ≦8.0 times is preferred because the flow-drawing state can be realized. A drawing magnification of ≧1.2 times is preferred because the flow-drawing state can be realized with satisfactory productivity. When the drawing magnification is 1.4 to 5.0 times, the balance between ease of realizing the flow-drawing state and productivity is excellent, and a range of 1.6 to 3.0 times is even better.

The drawing method is not particularly limited in the present invention when obtaining the first hot-melt adhesive conjugate fiber of the present invention, and traditional methods such as hot roll drawing, hot water drawing, pressurized steam drawing, zone drawing, and the like may be used. For the flow-drawing state to be realized easily and stably, it is important to raise the temperature so that the molecular mobility of the polymer chains when they are drawn will be sufficiently high, and from that viewpoint, hot roll drawing wherein preliminary heating and temperature raising are performed prior to the starting position for drawing is preferred over methods wherein heating is performed at the starting position for drawing.

The uniformity of temperature of the fibers at the starting position for drawing is not particularly limited in the present invention, but it is desirable to have uniformity among the fibers of a multi-fiber and within single fibers in the longitudinal direction. For the uniformity among fibers, a temperature difference of ≦5° C. is preferred because the flow-drawing state is stabilized thereby, and a difference of ≦3° C. is more preferred. Thus, to increase the uniformity among fibers, it is preferable to decrease the number of fibers and spread them apart so they do not converge during drawing, but without greatly decreasing productivity. With respect to the longitudinal orientation of single fibers, a temperature difference of ≦5° C. is preferred, and a difference of ≦3° C. is more preferred. Thus, to increase uniformity in the longitudinal direction of single fibers, it is preferable to control temperature fluctuations of the hot rolls, and from that viewpoint, it is desirable to use induction heating therefor.

In the first hot-melt adhesive conjugate fiber of the present invention obtained by undergoing the flow-drawing process, the birefringence of the polyester first component is ≦0.150, and more preferably it is ≦0.100. Herein, the term "low birefringence" refers to a low level of molecular orientation. In the flow-drawing process, drawing is performed as the entangled structure of the polymer chains is being opened up, so it is not accompanied by pronounced molecular orientation due to drawing. As a result, when the birefringence of the first component of the drawn conjugate fiber is ≦0.150, it means that the fiber has been obtained by undergoing the flow-drawing process instead of neck drawing, which is accompanied by pronounced molecular orientation, and a birefringence of ≦0.100 is even more preferred because it means that opening up of the polymer chains in the flow-drawing process has been effectively realized.

In the first hot-melt adhesive conjugate fiber of the present invention obtained by undergoing the flow-drawing process, the birefringence ratio of the first component to the second component (birefringence of the first component/birefringence of the second component) is ≦3.0, and more preferably, ≦2.5.

When flow-drawing an undrawn yarn wherein polyester is the first component and an olefin polymer is the second component, the first component is drawn while opening the polymer chains, so the increase in the birefringence thereof is restricted in comparison with neck drawing, and the fiber structure therein develops very little. In contrast, the olefin polymer second component does not achieve a flow-drawing state, the birefringence thereof increases essentially as much as when neck drawing is performed, and the fiber structure develops therein. In other words, the fact that the birefringence ratio of the first component to the second component (birefringence of the first component/birefringence of the second component) is ≦3.0 means that the conjugate fiber was obtained by undergoing the flow-drawing process, and a birefringence ratio of ≦2.5 is preferred because it means that the conjugate fiber has undergone the flow-drawing process even more effectively.

The fiber strength of the hot-melt adhesive conjugate fiber of the present invention obtained by undergoing the flow-drawing process is not particularly limited in the present invention, but is preferably ≦2.0 cN/dtex, and more preferably, ≦1.5 cN/dtex. When the conjugate fiber undergoes an effective flow-drawing process, the development of the orientation structure of the polymer chains is restricted and the fiber strength does not become very large. As a result a fiber strength of ≦2.0 cN/dtex means that the conjugate fiber has undergone an effective flow-drawing process, and a fiber strength of ≦1.5 cN/dtex means that the conjugate fiber has undergone an even more effective flow-drawing step.

The elongation of the hot-melt adhesive conjugate fiber of the present invention obtained by undergoing the flow-drawing process is not particularly limited in the present invention, but it is preferably ≧100%, and more preferably, ≧200%. When the conjugate fiber has undergone an effective flow-drawing process, the development of the orientation structure of the polymer chains has been restricted and the elongation increases. An elongation of ≧100% means that the conjugate fiber has undergone an effective flow-drawing process, and that state is preferred because it can be redrawn in a subsequent step to obtain an ultrafine, high strength fiber, and an elongation of ≧200% is even more preferred because the drawing magnification in the subsequent step can be increased.

The mean index of refraction of the first component of the hot-melt adhesive conjugate fiber of the present invention obtained by undergoing the flow-drawing process is preferably ≦1.600, more preferably ≦1.595, and even more preferably ≦1.590.

Herein, the mean index of refraction correlates with the density of that component, i.e., it is a numerical value that reflects the degree of crystallization of that component. If the degree of crystallization due to drawing increases, the density also increases, and the mean index of refraction has a larger value. In other words, when the mean index of refraction of the first component of the hot-melt adhesive conjugate fiber is small, it means that pronounced crystallization due to drawing did not occur.

A mean index of refraction of the first component of ≦1.600 means that a restrictive effect on fiber structure development due to flow drawing has acted, and this is preferred because in a subsequent step redrawing is possible and the fiber can be made into an ultrafine, high strength fiber. The mean index of refraction of the first component is ≦1.595, and even more preferably ≦1.590, because the drawing magnification can be increased in the subsequent step thereby.

The heat shrinkage properties of the hot-melt adhesive conjugate fiber are not particularly limited in the present invention, but the dry heat shrinkage rate resulting from a heat treatment at 145° C. for 5 min is preferably ≧15%, and more preferably ≧25%. The hot-melt adhesive conjugate fiber of the present invention is drawn by undergoing a flow-drawing process, and therefore the degree of crystallization of the first component is held low, and the shrinkage resulting from a heat treatment tends to be increased thereby. Such a conjugate fiber can be used most suitably as a heat-shrinkable fiber. The fact that the dry heat shrinkage rate of this conjugate fiber is high means that it has undergone an effective flow-drawing process, i.e., the fiber structure is developed little, and this is preferred because when redrawing is performed in a subsequent step the fiber can be drawn at a high magnification.

The first hot-melt adhesive conjugate fiber of the present invention is obtained by undergoing the flow-drawing process, and therefore the fiber structure development therein is restricted, and the fiber can be redrawn. The redrawing step may be consecutive with the flow-drawing process for obtaining the hot-melt adhesive conjugate fiber of the present invention although no problem will occur if it is not consecutive. However, in consideration of process step stability and productivity, making the redrawing step consecutive is preferred. One example of a consecutive drawing step is a 2-step drawing process using 3 pairs of hot rolls wherein a flow-drawing process comprises the first drawing step and a neck drawing process comprises the second drawing step.

The second hot-melt adhesive conjugate fiber of the present invention is a hot-melt adhesive conjugate fiber characterized in that the fiber comprises a polyester as the first component and an olefin polymer with a melting point lower than the first component as the second component, the degree of orientation of the c-axis of the crystalline member of the second component of the hot-melt adhesive conjugate fiber is ≧90%, and the single yarn fiber strength of the hot-melt adhesive conjugate fiber is ≧1.7 cN/dtex, preferably ≧2.5 cN/dtex.

The method whereby such a hot-melt adhesive conjugate fiber having the olefin polymer second component oriented to a high degree and having a relatively high fiber strength for a resin structure of polyester/olefin polymer is not particularly limited in the present invention. As noted above, however, the hot-melt adhesive conjugate fiber of the present invention characterized in that it comprises a polyester first component and an olefin polymer second component, the birefringence of the polyester first component is ≦0.150, and the birefringence ratio of the first component to the second component (birefringence of the first component/birefringence of the second component) is ≦3.0 can be obtained easily, and stably with high productivity by performing redrawing. No problem occurs whatsoever if the fiber is obtained by another method. In other words, the fiber serving as the raw material for the second hot-melt adhesive conjugate fiber of the present invention is not particularly limited, and as noted above, although the first hot-melt adhesive conjugate fiber of the present invention obtained by undergoing a flow-drawing process is one example thereof, the present invention does not exclude using another fiber as a raw material for the second hot-melt adhesive conjugate fiber.

The polyester first component of the second hot-melt adhesive conjugate fiber of the present invention is not particularly limited, and as noted above, examples include a polyalkylene terephthalate such as polyethylene terephthalate and polytrimethylene terephthalate, polybutylene terephthalate, and the like; a biodegradable polyester such as polylactate and the like; and a copolymer of the above with another ester forming component, and the like. Examples of another ester forming component include a glycol such as diethylene glycol, polymethylene glycol and the like; and an aromatic dicarboxylic acid such as isophthalic acid, hexahydroterephthalatic acid, and the like. When a copolymer with another ester forming component is used, the composition of the copolymer is not particularly limited in the present invention, but it is preferable that crystallinity not be greatly lost, and from this viewpoint, it is desirable that the copolymer component preferably be ≦10 wt %, and more preferably ≦5 wt %. These ester polymers may be used alone or in combinations of 2 or more types without a problem. In consideration of the raw material costs, heat stability of the obtained fiber, and the like, a polyester having polyethylene terephthalate as the main component thereof is preferred, and more preferably, an unmodified polymer consisting of polyethylene terephthalate alone is most suitable.

The olefin polymer second component is not particularly limited in the prevent invention provided it has a lower melting point than the first component, and as noted above, examples include low density polyethylene, linear low density polyethylene, high density polyethylene and the maleic anhydride-modified products of those ethylene polymers; and ethylene-propylene copolymer ethylene-butene-propylene copolymer, polypropylene, and the maleic anhydride-modified products of those propylene polymers; poly-4-methylpentene-1; and the like.

This olefin polymer may be used alone or in combinations of 2 or more types without any problem whatsoever. Among these, an olefin polymer containing ≧90 wt % high density polyethylene is preferred from the viewpoint of controlling the phenomenon wherein olefin polymers exposed on the fiber surface fuse without completely solidifying in the cooling process during spinning.

In addition, the melt flow rate (test temperature 230° C., test load of 21.18 N) of the olefin polymer is not particularly limited in the present invention, but preferably it is ≧8 g/10 min, more preferably ≧20 g/10 min, and more preferably ≧40 g/min. When different components are conjugated and spun, both components affect each other and the structure of the undrawn yarn changes, but when a polyester and an olefin polymer are conjugated, the birefringence of the polyester tends to decrease if the melt flow rate of olefin polymer is large. If the melt flow rate of the olefin polymer is ≧20 g/10 min, it is possible to easily obtain undrawn yarn in which the first component birefringence is small, and if the melt flow rate is ≧40 g/10 min, it is possible to obtain undrawn yarn in which the birefringence is even smaller.

In the second hot-melt adhesive conjugate fiber of the present invention additives to exhibit various types of performance such as antioxidants and photostabilizers, UV light absorbers, neutralizers, nucleating agents, antibacterial agents, deodorizing agents, flame retardants, antistatic agents, pigments, plasticizers, and the like may be suitably added as needed to the polyester first component and the olefin polymer second component within a range that does not interfere with the effect of the present invention.

The type of conjugation of the first component and the second component is not particularly limited in the second hot-melt adhesive conjugate fiber of the present invention, but a type of conjugation wherein the second component completely covers the fiber surface is preferred, and among such types, a concentric or eccentric sheath-core structure is preferred. When the type of conjugation is one wherein the low-melting point olefin polymer second component completely covers the fiber surface, hot-melt adhesion can be obtained over the entire fiber surface, and therefore a high strength hot-melt adhesive nonwoven fabric can be obtained. In addition, as noted above, the cross-sectional shape of the fiber is not particularly limited in the present invention, and a round type such as circular or elliptical: an angular type such as triangular or quadrangular; an atypical type such as key-shaped or octolobal; or a hollow type and the like can be used.

The structural ratio when conjugating the first component and second component is not particularly limited in the present invention, but a ratio of second component/first component=70/30 to 10/90 vol % is preferred, and 60/40 to 30/70 vol % is more preferred. If the structural ratio of the second component is ≧10 vol %, suitable adhesion points form when obtaining a hot-melt adhesive nonwoven fabric, and a hot-melt adhesive nonwoven fabric with satisfactory strength can be obtained. If the structural ratio of the first component is ≧30 vol %, loss of bulk can be controlled when obtaining the hot-melt adhesive nonwoven fabric, and a very bulky hot-melt adhesive nonwoven fabric can be obtained. A conjugation rate of the first component to the second component in the range of 60/40 to 30/70 vol % is most suitable because a hot-melt adhesive nonwoven fabric with an excellent balance of bulkiness and nonwoven fabric strength can be obtained.

As noted above, the second hot-melt adhesive conjugate fiber of the present invention is one obtained easily and stably at high productivity by redrawing the first hot-melt adhesive conjugate fiber of the present invention, and therefore it is preferable to use the first fiber as the material for the second fiber. That is because the second hot-melt adhesive conjugate fiber is characterized in that if this drawing method is employed, drawing can be performed at a higher magnification than with past thawing methods.

In the initial drawing step the polyester first component achieves a flow-drawing state, and the fiber structure develops very little, but because the olefin polymer second component does not achieve a flow-drawing state, it can be made finer as the fiber structure develops. In the subsequent redrawing step the fiber structure of the polyester first component develops sufficiently by setting the drawing conditions such that the polyester first component undergoes neck drawing, and the fiber structure developed in the previous step develops even further in the olefin polymer second component resulting in a fiber structure with a high degree of orientation. Particularly noteworthy is the fact that drawing at a high level of magnification, which is unattainable when drawing fibers spun using olefin polymer alone, can be realized at that time by adopting a mode wherein the olefin polymer is one component constituting a conjugate fiber and takes the form of conjugation with polyester. Thereby, the olefin polymer component can attain a high degree of fiber structure development that matches the high drawing magnification and that cannot be realized by using the olefin polymer alone.

When the degree of orientation of the c-axis of the crystalline member of the olefin polymer second component is ≧90%, preferably ≧92%, the olefin polymer second component exhibits a particularly high degree of orientation, and as a result the single yarn fiber strength of the conjugate fiber is ≧1.7 cN/dtex, preferably ≧2.5 cN/dtex, more preferably ≧2.8 cN/dtex, and even more preferably ≧3.0 cN/dtex. Thus, unexpected effects are provided thereby such as increased wear resistance of the conjugate fiber, increased carding workability when making a nonwoven fiber therefrom, and the like.

For example, when carding an ultrafine thermoplastic fiber of 1.0 to 1.5 dtex, the fineness value of the thermoplastic fiber is so small that problems such as sinking into the cylinder and napping easily occur, and satisfactory productivity cannot be obtained. However, the hot-melt adhesive conjugate fiber described above has high fiber strength, high stiffness, and excellent wear resistance, so sinking into the cylinder and napping are not likely to occur during carding, even though the fiber is very fine, it is possible to increase the operating speed of the carding machine to achieve a high level of productivity.

The drawing conditions when redrawing the first hot-melt adhesive conjugate fiber of the present invention are not particularly limited, but the drawing temperature is preferably 5 to 30° C. higher, more preferably 10 to 30° C. higher, and more preferably 15 to 25° C. higher, than the glass transition temperature of the polyester first component such that a neck drawing process is performed, because the c-axis orientation of the crystalline member of the olefin polymer second component becomes higher thereby, and a hot-melt adhesive conjugate fiber with excellent heat stability, abundant bulkiness, and even higher fiber strength can be obtained. A drawing temperature that is "the glass transition temperature of the polyester first component+10° C." or higher is preferred because molecular mobility of the first component can be obtained to the extent that does not invite a pronounced drop in productivity due to yarn breakage during drawing. A drawing temperature that is "the glass transition temperature of the polyester first component+30° C." or lower is even more preferred because molecular orientation and oriented crystallization proceed due to drawing without the molecular mobility of the first component becoming too high. A drawing temperature that is 15 to 25° C. higher than the glass transition of the first component is preferred because the balance between productivity and properties of the obtained fiber is excellent.

The drawing speed when redrawing the first hot-melt adhesive conjugate fiber of the present invention is not particularly limited, but in consideration of productivity and process step stability, a range of 50 to 200 m/min is preferred, and a range of 80 to 150 m/min is more preferred.

In addition, the drawing magnification in the redrawing step is not particularly limited in the present invention, but to obtain a drawn fiber with excellent heat stability, bulk, and strength properties the highest magnification within a range that does not cause fiber breakage is better, and from that viewpoint a magnification of 1.5 times or higher is preferred, and 1.8 times or higher is more preferred. In addition, the total magnification, which is the product of the drawing magnification in the flow-drawing process and drawing magnification when redrawing the hot-melt adhesive conjugate fiber of the present invention obtained by the flow-drawing process, is not particularly limited in the present invention, but 4 times or greater is preferred, 6 times or greater is more preferred, and 7 times or greater is particularly preferred. The present invention is characterized in that if the drawing method is employed wherein a hot-melt adhesive conjugate fiber obtained by undergoing the flow-drawing process is redrawn, in drawing can be performed at a higher total drawing magnification than in past drawing methods. Being able to draw at a high magnification means obtaining the effect of fineness wherein an undrawn yarn of a certain fineness can be drawn even finer, and a productivity-increasing effect due to stabilization of the spinning step and increased discharge amount because the fineness value of undrawn yarn for obtaining drawn yarn of a certain fineness can be set higher. When the total drawing magnification is 4 times or greater, these effects can be obtained, when it is 6 times or greater, these effects can be obtained at a somewhat satisfactory level, and when it is 7 times or greater, these effects can be obtained at a sufficiently high level, so the latter is preferred.

The fineness of the second hot-melt adhesive conjugate fiber of the present invention is not particularly limited, but it is preferably 4 dtex or less, and more preferably 2 dtex or less.

As noted above, the drawing method of the present invention wherein a hot-melt adhesive conjugate fiber obtained by undergoing the flow-drawing process is redrawn has the advantage of enabling the total drawing magnification to be made higher than in past drawing methods and enabling finer fibers to be produced with high productivity. A fineness of 4 dtex or less is preferred because the number of fibers per unit weight increases, and for example, the filtering properties are increased when the fibers are used as a filter material and a low metsuke (mass per unit area) is possible due to increased compactness when the fiber is used in a hot-melt adhesive unwoven fabric, and also a soft texture can be obtained. A fineness of 2 dtex or less is more preferred because the above effects can be obtained at an even higher level.

It is desirable to apply a surfactant to the surface of the fibers in the first hot-melt adhesive conjugate fiber and the second hot-melt adhesive conjugate fiber of the present invention to satisfy working suitability and finished product properties. The type of surfactant is not particularly limited in the present invention and a publicly known method for applying the surfactant, for example, by roller, immersion, spraying, pat drying, and the like can be used.

The first hot-melt adhesive conjugate fiber and the second hot-melt adhesive conjugate fiber of the present invention can be used in a variety of applications, and can be made into a variety of fiber forms to suit those applications.

For example, in the case of a fiber for use in a carded unwoven fabric, a crimped staple fiber form is preferred. The type of crimping is not particularly limited in the present invention, and it may be zig-zag mechanical crimping or three-dimensional crimping in the form of an Omega (Ω) or spiral. In addition, the fiber length and number of crimps are not particularly limited in the present invention, and can be suitably selected in response to the properties of the fiber and the carding machine.

For fibers used in woven filters and fibers used in winding filters, fibers used in woven sheets, fibers used in knitted nets and the like, filament-type fiber is preferred. For fibers used in air laid nonwoven fabrics, fibers used in paper nonwoven fabrics, or fibers used for reinforcing concrete and the like, a short cut-chop type is preferred. The type of crimp, or the presence or absence thereof, and the fiber length are not particularly limited in the present invention, and can be suitably selected in consideration of the type of processing equipment, required properties, productivity, and the like. For fibers used in rods, fibers used in winding filters, and fibers used as the raw material for wiping products and the like, an uncut continuous tow form is preferred. The type of crimp, or the presence or absence thereof, is not particularly limited in the present invention, and can be suitably selected in response to the processing method and desired properties of the product.

EXAMPLES

The present invention is described in greater detail below through examples, but is by no means limited thereto. In addition, the methods for measuring physical values and definitions presented in the examples are also described below.

(1) Birefringence

The diameter of the fiber and the diameter of the core and retardation were measured using an Interfaco interference microscope manufactured by Carl Zeiss Jena, the index of refraction was determined in the directions parallel and perpendicular to the fiber axis, and the mean index of refraction and birefringence were calculated therefrom.

(2) Crystalline Member c-Axis Degree of Orientation

A wide angle x-ray diffraction measurement was performed using a D8 DISCOVER made by Bruker AXS. The x-ray source was CuK α-rays (wavelength: 0.154 nm) generated at a voltage of 45 kV and current of 360 mA. The degree of orientation of the crystalline member c-axis with respect to the axis of orientation was calculated by the Wilchinsky method from the intensity profile of the azimuth angle in the direction of the (200) plane for PP and the (200) plane for PE.

(3) Single Yarn Fineness, Single Yarn Elongation

Measurements of undrawn yarn and drawn yarn were performed in accordance with JIS-L-1015.

(4) Dry Heat Shrinkage Rate

The shrinkable fibers were cut into lengths approximately 500 mm long, heat treated for 5 min in a 145° C. circulating oven, and the dry heat shrinkage rate was calculated according to the following formula.

Dry heat shrinkage(%)=(fiber length before heat treatment−fiber length after heat treatment)÷fiber length before heat treatment×100

(5) Standard Deviation of Fiber Diameter

An image of the hot-melt adhesive conjugate fibers was taken using a model VC2400-IMU 3D digital fine scope (manufactured by Omron Corp.), the fiber diameter was measured for n=50, and the standard deviation thereof was calculated.

(6) Olefin Polymer Melt Flow Rate (MFR)

The MFR was measured at a test temperature of 230° C. with a test load of 21.18 N (Test condition 14 of JIS-K-7210 "Table 1").

(7) Drawing Magnification

The drawing magnification was calculated from the fineness before and after drawing.

Drawing magnification=(fineness before drawing)÷(fineness after drawing)

(8) Drawing Step Stability

The stability of the drawing step was evaluated using the symbols ○ and x.

○: Stoppage of drawing process due to fiber breakage and agglutination between fibers less than 1 time/hour.

x: Stoppage of drawing process due to fiber breakage and agglutination between fibers 1 or more times/hour.

(9) Carding Workability

The obtained fibers were carded, observed for high speed processing, web uniformity, nep content, etc., and evaluated on a four-step scale of A, B, C, or D.

Example 1

Undrawn yarn with a fineness of 8.2 dtex was obtained by combining polyethylene terephthalate (PET) (IV value: 0.64, glass transition temperature: 82° C.) as the first component with high density polyethylene (HDPE) (melt flow rate: 36 g/10 min) as the second component, and using a concentric sheath-core nozzle, conjugating the components into a sheath/core=second component/first component=50/50 (vol %) cross sectional shape, and spinning at a rate of 900 m/min. The birefringence of the first component thereof was 0.016. When the obtained undrawn yarn was hot roll drawn (temperature: 120° C., speed: 25 m/min, magnification: 2.0 times), drawn yarn with a fineness of 4.1 dtex was stably obtained, and it was uniform with a fiber diameter standard deviation of 2.01. The birefringence of the first component thereof was 0.033, the birefringence ratio (birefringence of the first component/birefringence of the second component) was 1.16, and the elongation was 312%. When the dry heat shrinkage was measured, it was a high 22%, and this fiber was suitable for use as a shrinkable fiber. Because the elongation was a large 312%, when redrawing was performed (temperature: 90° C., speed: 100 m/min), drawing could be stably performed at a magnification of 3.7 times. The total drawing magnification from the first drawing and the second drawing was 7.5 times, the fineness of the ultimately obtained hot-melt adhesive conjugate fiber was 1.1 dtex, the fiber diameter standard deviation was 1.89, and the degree of orientation of the c-axis of the crystalline member of the HDPE second component was 96%. The fiber strength was 3.7 cN/dtex, and the fibers were very strong. Mechanical crimping at a crimp number of 14 crimps/2.54 cm was performed on the fiber, and after a heat treatment at 110° C., the fiber was cut to a fiber length of 38 mm to obtain staple. When the staple fiber was carded, the carding throughput was good, and it was possible to set the processing speed high. Next, when an air-through nonwoven fabric was produced by melting and adhering the fibers together using the air-through method, the fabric had an extremely soft texture, possibly because the fineness value was very small, and the fabric could be suitably used as the top sheet of a napkin, for example.

Example 2

The same undrawn yarn as in example 1 was hot roll drawn (temperature: 120° C., speed: 40 m/min, magnification: 3.0 times). In other words, the drawing magnification was different from example 1, but a drawn yarn with a fineness of 2.7 dtex was stably obtained, and the yarn was uniform with a fiber diameter standard deviation of 1.77. The birefringence of the first component was 0.136, and the birefringence ratio (birefringence of the first component/birefringence of the second component) was 2.67, and the elongation was 176%. When the dry heat shrinkage rate was measured, a high shrinkage rate of 17% was found. The shrinkage rate was lower than in example 1, possibly because the drawing magnification was not as high, but the fiber could be suitably used as a shrinkable fiber. Next, when the fiber was redrawn (temperature: 90° C., speed: 100 m/min), it could be stably drawn at a magnification of 2.3 times. The total drawing magnification from the first drawing and the second drawing was 6.8 times, which was lower than in example 1, but an ultrafine, strong, uniform hot-melt adhesive conjugate fiber could be stably obtained (ultimate fineness: 1.2 dtex, fiber diameter standard deviation: 1.72, degree of orientation of the c-axis of the crystalline member of the HDPE second component: 93%, fiber strength 3.3 cN/detex). Mechanical crimping at a crimp number of 15 crimps/2.54 cm was performed on the fiber, and after a heat treatment at 100° C., the fiber was cut to a fiber length of 44 mm to obtain staple. When the staple fiber was carded, the carding throughput was good, and it was possible to set the processing speed high. Next, an air-through nonwoven fabric was produced by melting and adhering the fibers together using the air-through method. When this was used as an air filter filtering material, excellent filtering properties were obtained because the fineness value was small.

Example 3

Undrawn yarn with a fineness of 16.8 dtex was obtained by combining PET (IV value: 0.64, glass transition temperature: 82° C.) as the first component with HDPE (melt flow rate: 28 g/10 min) as the second component, and using a concentric sheath-core nozzle, conjugating the components into a sheath/core=second component/first component=30/70 volume fraction (vol %) cross sectional shape, and spinning at a rate of 450 m/min. The birefringence of the first component thereof was 0.008. When continuous two-stage drawing was performed on the obtained undrawn yarn in a drawing machine with 3 pairs of hot rolls (flow-drawing first stage temperature: 110° C., speed: 30 m/min, magnification: 2.5 times; neck drawing second stage temperature 85° C., speed: 100 m/min, magnification: 2.8 times; total magnification 7.8 times), a hot-melt adhesive conjugate fiber was stably obtained (fineness: 2.4 dtex, fiber diameter standard deviation: 1.42, degree of orientation of the c-axis of the crystalline member of the HDPE second component: 93%, fiber strength: 3.5 cN/detex). When drawn intermediate yarn that had completed the flow-drawing first stage was used, the fineness was 6.7 dtex, the birefringence of the first component was 0.056, the birefringence ratio was 1.45, and the elongation was 262%. Mechanical crimping at a crimp number of 16 crimps/2.54 cm was performed on the drawn yarn obtained by continuous two-stage drawing, and after a heat treatment at 100° C., the fiber was cut to a fiber length of 51 mm to obtain staple. When the staple fiber was carded and an air-through nonwoven fabric was produced, the carding process step was good, and the product exhibited nonwoven fabric properties equivalent to a nonwoven fabric with a fineness of 2.4 dtex obtained by traditional neck drawing alone. The hot-melt adhesive conjugate fiber of the present invention was produced at a high drawing magnification, and compared with attempts to obtain a 2.4 dtex hot-melt adhesive conjugate fiber by previous drawing methods, the fineness of the undrawn yarn can be made larger. This means that the discharge amount during spinning can be increased, i.e., an effect of increased productivity is obtained.

Example 4

Undrawn yarn with a fineness of 6.2 dtex was obtained by combining PET (IV value: 0.64, glass transition temperature: 82° C.) as the first component with a mixture (90/10 mass fraction (wt %)) of HDPE (melt flow rate: 36 g/10 min) and maleic anhydride-modified polyethylene (melt flow rate: 24 g/10 min) as the second component, and using a concentric sheath-core nozzle, conjugating the components into a sheath/core=second component/first component=60/40 volume fraction (vol %) cross sectional shape, and spinning at a rate of 800 m/min. The birefringence of the first component was 0.015. When continuous two-stage drawing was performed on the obtained undrawn yarn in a drawing machine with 3 pairs of hot rolls (flow-drawing first stage temperature: 125° C., speed: 15 m/min, magnification: 2.0 times; neck drawing second stage temperature 85° C., speed: 70 m/min, magnification: 3.9 times; total magnification 7.8 times), a hot-melt adhesive conjugate fiber was stably obtained (fineness: 0.8 dtex, fiber diameter standard deviation: 1.02, degree of orientation of the c-axis of the crystalline member of the HDPE second component: 94%, fiber strength: 3.5 cN/dtex). When drawn intermediate yarn that had completed the flow-drawing first stage was used, the fineness was 3.1 dtex, the birefringence of the first component was 0.039, the birefringence ratio was 1.30, and the elongation was 322%. Mechanical crimping at a crimp number of 11 crimps/2.54 cm was performed on the drawn yarn obtained by continuous two-stage drawing, and after a heat treatment at 100° C., the fiber was cut to a fiber length of 5 mm to obtain a dry crimp-chop. A blend was prepared with coarse pulp at 20/80 mass fraction (wt %), a web was formed by the air laid method, and an air-through unwoven fabric was obtained. Because the fineness of the hot-melt adhesive conjugate fiber has a low value, the number of constituent strands thereof is large, the number of contact points between the hot-melt adhesive conjugate fiber and the pulp is increased thereby, so the adhesiveness is enhanced and the effect of physically retaining the pulp is higher, the strength of the nonwoven fabric is high even if the surface thereof is not treated with latex, and a pulp blend nonwoven fabric with excellent pulp retention could be obtained. When the fabric was used as a wet wipe, it could be used most suitably therefor because water absorbency was excellent since a latex treatment was not performed, and there was little loss of pulp.

Example 5

Undrawn yarn with a fineness of 8.1 dtex was obtained by combining PET (IV value: 0.64, glass transition temperature: 82° C.) as the first component with polypropylene (PP) (melt flow rate: 40 g/10 min) as the second component, and using a concentric sheath-core nozzle, conjugating the components into a sheath/core=second component/first component=50/50 volume faction (vol %) cross sectional shape, and spinning at a rate of 600 m/min. The birefringence of the first component thereof was 0.012. When continuous two-stage drawing was performed on the obtained undrawn yarn in a drawing machine with 3 pairs of hot rolls (flow-drawing first stage temperature: 140° C., speed: 40 m/min, magnification: 3.0 times; neck drawing second stage temperature 85° C., speed: 90 m/min, magnification: 1.9 times; total magnification 5.8 times), a hot-melt adhesive conjugate fiber was stably obtained (fineness: 1.4 dtex, fiber diameter standard deviation: 0.97, degree of orientation of the c-axis of the crystalline member of the PP second component: 96%, fiber strength: 3.4 cN/dtex). When drawn intermediate yarn that had completed the flow-drawing first stage was used, the fineness was 3.7 dtex, the birefringence of the first component was 0.109, the birefringence ratio was 2.27, and the elongation was 186%. Mechanical crimping at a crimp number of 14 crimps/2.54 cm was performed on the drawn yarn obtained by continuous two-stage drawing, and after a heat treatment at 120° C., the fiber was cut to a fiber length of 38 mm to obtain staple. When the staple fiber was carded and a point bond nonwoven fabric was produced, the carding process step was good, and because the fineness value was low, the number of constituent strands thereof was high, and no unevenness in texture occurred even when the metsuke of the unwoven fabric was decreased.

Example 6

Undrawn yarn with a fineness of 6.4 dtex was obtained by combining PET (IV value: 0.64, glass transition temperature: 82° C.) as the first component with linear low density polyethylene (LLDPE) (melt flow rate: 54 g/10 min) as the second component, and using a eccentric sheath-core nozzle, conjugating the components into a sheath/core=second component/first component=50/50 volume fraction (vol %) cross sectional shape, and spinning at a rate of 750 m/min. The degree of eccentricity as defined by the following formula was 0.22, and the birefringence of the first component was 0.016.

Degree of eccentricity (h)=d/r r: radius of entire fiber d: distance from center of entire fiber to center of core component When continuous two-stage drawing was performed on the obtained undrawn yarn in a drawing machine with 3 pairs of hot rolls (flow drawing first stage temperature: 105° C., speed: 15 m/min, magnification: 2.0 times; neck drawing second stage temperature 90° C., speed: 50 m/min, magnification: 2.7 times; total magnification 5.4 times), a hot-melt adhesive conjugate fiber was stably obtained (fineness: 1.2 dtex, fiber diameter standard deviation: 1.16, degree of orientation of the c-axis of the crystalline member of the PP second component: 91%, fiber strength: 2.6 cN/dtex). When drawn intermediate yarn that had completed the flow-drawing first stage was used, the fineness was 3.2 dtex, the birefringence of the first component was 0.047, the birefringence ratio was 1.38, and the elongation was 248%. Mechanical crimping at a crimp number of 14 crimps/2.54 cm was performed on the drawn yarn obtained by continuous two-stage drawing, and after a heat treatment at 110° C., the fiber was cut to a fiber length of 38 mm to obtain staple. The staple fiber was carded to produce an air-through unwoven fabric. Normally a hot-melt adhesive conjugate fiber using LLDPE, which has a level of friction, in the sheath component results in poor carding workability, but in the hot-melt adhesive conjugate fiber obtained by the method of example 6 the LLDPE sheath component is highly oriented, and carding workability was good, possibly because the friction was decreased as a result thereof. The obtained nonwoven fabric had a soft texture coming from the low fineness value, and the soft feel of the LLDPE constituting the surface of the fabric and bulk of the unwoven fabric originating in the eccentric cross-sectional shape make this fabric most suitable for use as the surface material of a paper diaper.

Comparative Example 1

When the same undrawn yarn as in example 1 was hot roll drawn (temperature: 90° C., speed: 25 m/min, magnification: 2.0 times), 4.1 dtex drawn yarn that was uniform with a fiber diameter standard deviation of 1.27 was obtained. The birefringence of the first component was 0.168, the birefringence ratio (birefringence of the first component/birefringence of the second component) was 5.79, and the elongation was 74%. The dry heat shrinkage was a low 7%. When an attempt was made to redraw this yarn at a temperature of 90° C. and speed of 100 m/min, drawing at a high magnification, as in example 1, could not be accomplished, and a magnification of 1.4 times was the best that could be reached. As a result, the total drawing magnification from the first drawing and the second drawing was 2.8 times, and the fineness value was 2.9 dtex, so an ultrafine hot-melt adhesive conjugate fiber could not be obtained as in example 1. In addition, when the carding workability thereof was compared with that of the fiber from example 3, which has about the same fineness value, it was clearly inferior because the operating speed could not be increased, and a large amount of neps were produced.

Comparative Example 2

Single component undrawn yarn of 8.2 dtex was obtained using PET (IV value: 0.64, glass transition temperature: 82° C., spinning speed: 1200 m/min). The birefringence thereof was 0.013. When hot roll drawing was performed on the obtained undrawn yarn (temperature: 110° C., speed: 40 m/min, magnification: 3.8 times), slack occurred between rolls because the drawing tension was low, which resulted in contact breakage, and runnability was clearly poor. Moreover, agglutination among fibers was pronounced, and the obtained drawn yarn had inferior release properties. Fineness was very uneven with a fiber diameter standard deviation of 5.59, and the uniformity of the quality was poor. When redrawing was performed on this yarn at a temperature of 125° C. and speed of 80 m/min, single yarn breakage occurred, possibly caused by unevenness in fineness. When the drawing magnification was slowly increased, wrapping around the drawing roll occurred, and the fineness value of the ultimately obtained yarn was 1.3 dtex. The total drawing magnification was 6.3 times, which was somewhat acceptable, but the fiber diameter standard deviation of the obtained fiber was a remarkably large 10.21, intermixing from a large number of areas with drawing breakage was visible to the naked eye, and quality stability was poor.

Comparative Example 3

Undrawn yarn with a fineness of 8.2 dtex was obtained by combining PP (melt flow rate: 16 g/10 min) as the first component with HDPE (melt flow rate: 36 g/10 min) as the second component, and using a concentric sheath-core nozzle, conjugating the components into a sheath/core=second component/first component=50/50 (vol %) cross sectional shape, and spinning at a rate of 1000 m/min. The birefringence of the first component thereof was 0.013. When continuous two-stage neck drawing was performed on the obtained undrawn yarn in a drawing machine with 3 pairs of hot rolls (first stage temperature: 90° C., speed: 25 m/min, magnification: 2.0 times; second stage temperature 90° C., speed: 55 m/min, magnification: 1.9 times), a hot-melt adhesive conjugate fiber was stably obtained (fineness: 2.2 dtex, fiber diameter standard deviation: 0.54, degree of orientation of the c-axis of the crystalline member of the HDPE second component: 86%). Even though neck drawing was attempted on the undrawn yarn comprising only olefin polymers, the drawing magnification could not be sufficiently increased, and as a result the degree of crystallization of the HDPE second component could not be raised to the level realized by the present invention. In addition, a staple was made under the same conditions as described in example 3, and carding workability was confirmed, but it was inferior to that of the hot-melt adhesive conjugate fiber of the same fineness obtained in example 3.

Comparative Example 4

When continuous two-stage drawing was performed (first stage temperature: 120° C., speed: 25 m/min, magnification: 2.0 times, second stage temperature: 90° C., speed: 55 m/min) using the undrawn yarn from comparative example 3 on a drawing machine with 3 pairs of hot rolls, the second stage drawing magnification could only be increased to 1.9 times as noted above, but a hot-melt adhesive conjugate fiber was obtained (fineness: 2.2 dtex, fiber diameter standard deviation: 0.59, degree of orientation of the c-axis of the crystalline member of the HDPE second component: 84%). The intention of the first stage drawing conditions was to realize the flow-drawing process, but that could not be achieved. In other words, the undrawn yarn comprising a sheath/core=second component/first component=HDPE/PP did not reach the flow-drawing state even when the drawing conditions were suitably controlled, and drawing at a high magnification could not be performed. In addition, a staple was made using the same conditions as in example 3, and carding workability was confirmed, but it was inferior to that of the hot-melt adhesive conjugate fiber of the same fineness obtained in example 3.

Comparative Example 5

Single component undrawn yarn with a fineness of 10.0 dtex was obtained using HPDE alone (melt flow rate: 36 g/10 min) at a drawing speed to 600 m/min. The birefringence was 0.013. When continuous two-stage neck drawing was performed on the obtained undrawn yarn in a drawing machine with 3 pairs of hot rolls (first stage temperature: 80° C., speed: 40 m/min, magnification: 3.0 times; second stage temperature 90° C., speed: 55 m/min, magnification: 1.2 times), a hot-melt adhesive conjugate fiber was stably obtained (fineness: 2.8 dtex, fiber diameter standard deviation: 0.79, degree of orientation of the c-axis of the crystalline member of the HDPE second component: 84%). Thus, even though neck drawing was attempted on the undrawn yarn comprising only olefin polymers, the drawing magnification could not be sufficiently increased, and as a result the degree of crystallization of the HDPE second component could not be raised to the level realized by the present invention. In addition, a staple was made using the same conditions as in example 3, and carding workability was confirmed, but it was inferior to that of the hot-melt adhesive conjugate fiber of the same fineness obtained in example 3.

Comparative Example 6

When continuous two-stage drawing was performed on the undrawn yarn from comparative example 5 in a drawing machine with 3 pairs of hot rolls (first stage temperature: 115° C., speed: 40 m/min, magnification: 3.0 times; second stage temperature 90° C., speed: 55 m/min, the second stage drawing magnification could only be increased to 1.2 times as in comparative example 5, but a hot-melt adhesive conjugate fiber was obtained (fineness: 2.2 dtex, fiber diameter standard deviation: 0.84, degree of orientation of the c-axis of the crystalline member of the HDPE second component: 84%). The intention of the first stage drawing conditions was to realize the flow-drawing process, but that could not be achieved. In other words, the undrawn yarn comprising only HDPE did not reach the flow-drawing state even when the drawing conditions were suitably controlled, and drawing at a high magnification could not be performed. In addition, a staple was made using the same conditions as in example 3, and carding workability was confirmed, but it was inferior to that of the hot-melt adhesive conjugate fiber of the same fineness obtained in example 3.

Below Table 1 summarizes the conditions and properties to the end of the first drawing step, and Table 2 summarizes the conditions and properties to the end of the redrawing step for the various aforementioned examples.

TABLE 1

| | 1st component | 2nd component | Undrawn yarn finess (dtex) | Drawing temp. (° C.) | Drawing speed (m/min) | Drawing magnification (times) | Fineness (dtex) |
|---|---|---|---|---|---|---|---|
| Ex. 1 | PET | HDPE | 8.2 | 120 | 25 | 2.0 | 4.1 |
| Ex. 2 | PET | HDPE | 8.2 | 120 | 40 | 3.0 | 2.7 |
| Ex. 3 | PET | HDPE | 16.8 | 110 | 30 | 2.5 | 6.7 |
| Ex. 4 | PET | HDPE + modified PE | 6.2 | 125 | 15 | 2.0 | 3.1 |
| Ex. 5 | PET | PP | 8.1 | 140 | 40 | 3.0 | 2.7 |
| Ex. 6 | PET | LLDPE | 6.4 | 105 | 15 | 2.0 | 3.2 |
| Comp. Ex. 1 | PET | HDPE | 8.2 | 90 | 25 | 2.0 | 4.1 |
| Comp. Ex. 2 | PET | — | 8.2 | 110 | 40 | 2.0 | 4.1 |
| Comp. Ex. 3 | PP | HDPE | 8.2 | 90 | 25 | 2.0 | 4.1 |
| Comp. Ex. 4 | PP | HDPE | 8.2 | 120 | 25 | 2.0 | 4.1 |
| Comp. Ex. 5 | HDPE | — | 10.0 | 80 | 40 | 3.0 | 3.3 |
| Comp. Ex. 6 | HDPE | — | 10.0 | 115 | 40 | 3.0 | 3.3 |

| | 1st component birefringence | Birefringence ratio | Fiber strength (cN/dtex) | Elongation (%) | Fiber diameter standard deviation | Mean refractive index of 1st component | Drawing step stability |
|---|---|---|---|---|---|---|---|
| Ex. 1 | 0.033 | 1.16 | 0.9 | 312 | 2.01 | 1.583 | ○ |
| Ex. 2 | 0.136 | 2.67 | 1.3 | 176 | 1.77 | 1.593 | ○ |
| Ex. 3 | 0.056 | 1.45 | 1.1 | 262 | 1.66 | 1.586 | ○ |
| Ex. 4 | 0.039 | 1.30 | 0.8 | 322 | 2.39 | 1.584 | ○ |
| Ex. 5 | 0.109 | 2.27 | 1.4 | 186 | 1.42 | 1.590 | ○ |
| Ex. 6 | 0.047 | 1.38 | 0.9 | 248 | 1.22 | 1.586 | ○ |
| Comp. Ex. 1 | 0.168 | 5.79 | 1.6 | 74 | 1.27 | 1.608 | ○ |
| Comp. Ex. 2 | 0.030 | — | 1.0 | 276 | 5.59 | 1.582 | x |
| Comp. Ex. 3 | 0.025 | 1.04 | 1.7 | 72 | 0.64 | 1.531 | ○ |
| Comp. Ex. 4 | 0.023 | 1.05 | 1.6 | 66 | 0.77 | 1.531 | ○ |
| Comp. Ex. 5 | 0.045 | — | 1.3 | 37 | 0.79 | 1.535 | ○ |
| Comp. Ex. 6 | 0.043 | — | 1.3 | 42 | 0.91 | 1.534 | ○ |

PET: polyethylene terephthalate

HDPE: High density polyethylene

LLDPE: Linear low density polyethylene

Modified PE: Maleic anhydride modified polyethylene

PP: polypropylene

TABLE 2

| | 1st component | 2nd component | Redrawing magnification (times) | Total drawing magnification (times) | Fineness (dtex) | Fiber strength (cN/dtex) | Elongation (%) | Fiber diameter standard deviation | Degree of c-axis orientation of crystalline member of 2nd component (%) | Carding workability |
|---|---|---|---|---|---|---|---|---|---|---|
| Ex. 1 | PET | HDPE | 3.7 | 7.5 | 1.1 | 3.7 | 42 | 1.89 | 96 | B |
| Ex. 2 | PET | HDPE | 2.3 | 6.8 | 1.2 | 3.3 | 51 | 1.72 | 93 | B |
| Ex. 3 | PET | HDPE | 2.8 | 7.0 | 2.4 | 3.5 | 67 | 1.42 | 93 | A |
| Ex. 4 | PET | HDPE + modified PE | 3.9 | 7.8 | 0.8 | 3.5 | 38 | 1.02 | 94 | — |
| Ex. 5 | PET | PP | 1.9 | 5.8 | 1.4 | 3.4 | 46 | 0.97 | 96 | B |
| Ex. 6 | PET | LLDPE | 2.7 | 5.4 | 1.2 | 2.6 | 53 | 1.16 | 91 | B |
| Comp. Ex. 1 | PET | HDPE | 1.4 | 2.8 | 2.9 | 2.1 | 57 | 1.52 | 86 | B |
| Comp. Ex. 2 | PET | — | | | | 3.9 | 36 | 10.21 | | D |
| Comp. Ex. 3 | PP | HDPE | 1.9 | 3.9 | 2.2 | 3.3 | 47 | 0.59 | 86 | B |
| Comp. Ex. 4 | PP | HDPE | 1.9 | 3.9 | 2.2 | 3.1 | 49 | 0.59 | 84 | B |
| Comp. Ex. 5 | HDPE | — | 1.2 | 3.6 | 2.8 | 2.3 | 51 | 0.79 | 82 | C |
| Comp. Ex. 6 | HDPE | — | 1.2 | 3.6 | 2.8 | 2.2 | 47 | 0.84 | 83 | C |

The invention claimed is:

1. A hot-melt adhesive conjugate fiber obtained by drawing an undrawn yarn having a polyester as a first component and an olefin polymer with a melting point lower than the first component, as a second component, the hot-melt adhesive conjugate fiber being characterized in that the birefringence of the polyester first component of the conjugate fiber is not more than 0.150, and the birefringence ratio of the first component to the second component (birefringence of the first component/birefringence of the second component) is not more than 3.0.

2. The hot-melt adhesive conjugate fiber according to claim 1, which is a type of conjugation in which the second component completely covers the fiber surface.

3. The hot-melt adhesive conjugate fiber according to claim 1, characterized in that the standard deviation of fiber diameter is not more than 4.0.

4. The hot-melt adhesive conjugate fiber of according to claim 1, characterized in that the single yarn fiber strength is not more than 2.0 cN/dtex, and the elongation is not less than 100%.

5. The hot-melt adhesive conjugate fiber according to claim 1, characterized in that the mean index of refraction of the polyester first component is not more than 1.600.

6. The hot-melt adhesive conjugate fiber of according to claim 1, characterized in that the olefin polymer second component is a high density polyethylene.

7. The hot-melt adhesive conjugate fiber according to claim 1, characterized in that the dry heat shrinkage resulting from a heat treatment of 145° C. for 5 minutes is not less than 15%.

8. A hot-melt adhesive conjugate fiber comprising a polyester as a first component and an olefin polymer with a melting point lower than the first component as a second component, the hot-melt adhesive conjugate fiber being characterized in that the degree of orientation of the c-axis of a crystalline member of the second component of the hot-melt adhesive conjugate fiber is not less than 90%, and the single yarn fiber strength of the hot-melt adhesive conjugate fiber is not less than 1.7 cN/dtex.

9. The hot-melt adhesive conjugate fiber according to claim 8, obtained by redrawing a conjugate fiber obtained by drawing an undrawn yarn having a polyester as a first component and an olefin polymer with a melting point lower than the first component, as a second component, the hot-melt adhesive conjugate fiber being characterized in that the birefringence of the polyester first component of the conjugate fiber is not more than 0.150, and the birefringence ratio of the first component to the second component (birefringence of the first component/birefringence of the second component) is not more than 3.0.

10. The hot-melt adhesive conjugate fiber according to claim 8, characterized in that the fineness is not more than 4.0 dtex.

11. The hot-melt adhesive conjugate fiber according to claim 8, characterized in that the fiber diameter standard deviation is not more than 4.0.

12. A sheet-shaped fiber assembly obtained by processing the hot-melt adhesive conjugate fiber according to claim 1.

13. A sheet-shaped fiber assembly obtained by processing the hot-melt adhesive conjugate fiber according to claim 8.

* * * * *